US005148748A

United States Patent [19]

Yarrington

[11] Patent Number: 5,148,748

[45] Date of Patent: Sep. 22, 1992

[54] OPTICAL DETONATOR

[76] Inventor: Arthur G. Yarrington, M.S. 1073, Crows Nest, Queensland 4355, Australia

[21] Appl. No.: 667,923

[22] Filed: Mar. 11, 1991

[51] Int. Cl.[5] ..... F42C 19/00

[52] U.S. Cl. ..... 102/201

[58] Field of Search ..... 102/201

[56] References Cited

U.S. PATENT DOCUMENTS

| | | | |
|---|---|---|---|
| 3,408,937 | 11/1968 | Lewis et al. | 102/201 |
| 3,747,530 | 7/1973 | Tepper | 102/213 |
| 3,812,783 | 5/1974 | Yang et al. | 102/201 |
| 4,391,195 | 7/1983 | Shann | 102/201 |
| 4,403,143 | 9/1983 | Walker et al. | 102/201 |
| 4,870,903 | 10/1989 | Carel et al. | 102/201 |
| 4,917,014 | 4/1990 | Loughry et al. | 102/201 |
| 4,984,518 | 1/1991 | Yarrington | 102/201 |

FOREIGN PATENT DOCUMENTS

| | | | |
|---|---|---|---|
| 3838896 | 5/1990 | Fed. Rep. of Germany | 102/201 |
| 8807170 | 9/1988 | World Int. Prop. O. | 102/201 |

*Primary Examiner*—Charles T. Jordan

*Attorney, Agent, or Firm*—Nikaido, Marmelstein, Murray & Oram

[57] ABSTRACT

The invention relates to an optical detonator including a device to accept a fiberoptic light guide cable 2 held by an attachable device within a elongated hollow body portion containing a frequency converter element 6 placed intermediate the fiberoptic light guide cable terminal end 2 and a quantity of contained explosive material 9 placed adjacent the closed end of the elongated hollow body portion 1 of the detonator.

An electromagnetic radiation pulse sent down the fiberoptic cable impinges on the intermediately housed frequency converter element 6 to be converted to infrared radiation energy to fire a "flashing" compound 7 to activate the explosive material 9 of the detonator.

5 Claims, 2 Drawing Sheets

OPTICAL DETONATOR

FIELD OF INVENTION

This invention is concerned with a detonator for explosive compositions and in particular to a detonator which is energized by electromagnetic radiation energy transmitted via a fiberoptic light guide cable or the like.

BACKGROUND OF THE INVENTION

Although not widely practiced, the use of radiation energy transmitted by a fiberoptic light cable for the detonation of explosives is widely known.

Electrically actuated detonators comprising a thermo resistive element coated with an initiation or "flashing" compound are well known. Such devices are inexpensive to manufacture and are known to be extremely reliable in use with a reasonable safety factor in storage and handling within defined parameters.

A major difficulty experienced with electrically actuated detonators is that they require connection to the detonating device via electrical conductive cables. Accidential explosions have been attributed to spurious electrical currents induced or conducted in the electrical cables by electrical machinery, static earth charges, lightning and the like.

In an endeavour to avoid the use of electrically conductive cables between a detonator and a device supplying energy thereto for actuation, nonelectrically conductive fiberoptic cables have been proposed.

Detonators employing fiberoptic energy transmitters all suffer from two major disadvantages—high cost and unreliability.

U.S. Pat. No. 3,408,937 describes a laser actuated detonator having a fiberoptic cable terminating within a mass of pyrotechnic material or separated therefrom by a concentrating lens. In the former case laser energy emitting from the end of the fiberoptic cable impinges directly on the pyrotechnic material. As the pyrotechnic material is inherently a poor heat conductor, immense energy pulses are required to ignite the pyrotechnic material. It has been found that such immense energy pulses can simply blast through the pyrotechnic material and as the duration of the pulse is so short, the heat energy is dissipated in the pyrotechnic without causing ignition.

In the latter case the lens is considered to be ineffective as there is no optical pathway to focus the laser light when the pyrotechnic material is located against the face of the lens.

The detonator described in U.S. Pat. No. 3,408,937 requires an immense amount of laser energy to produce an ignition temperature of around 2000° C. in the pyrotechnic material, but this amount of energy in a short duration pulse is sufficient to set up a shock wave capable of penetrating the pyrotechnic material without ignition. In a time delay detonator this can cause undesirable instant detonation of the explosive material in the detonator body.

U.S. Pat. No. 4,403,143 describes a detonating cord having a fiberoptic core formed therein. A free end of the fiberoptic cord is fitted with a reflector to enable continuity of the detonating cord to be checked. The detonating cord is ignited by a conventional electrically actuated detonator.

U.S. Pat. No. 4,391,195 describes a laser energy actuated detonator employing fiberoptic cable to transmit the laser energy. The detonator described in this patent comprises a sensitive pyrotechnic material coated on the end of a fiberoptic cable adjacent the detonator charge compound or in direct contact therewith in a manner similar to the detonator described in U.S. Pat. No. 3,408,937 above.

The problems of poor heat absorption in the pyrotechnic material are addressed by incorporating an energy absorbing pigment or dyestuff with a highly sensitive pyrotechnic.

U.S. Pat. No. 3,812,783 describes a laser actuated detonator comprising a focusing lens which focuses the laser energy on a metal film located on the opposite side of a transparent window. The laser energy causes the metal film to vaporize and cause a shock wave to detonate explosive material in the detonator body.

U.S. Pat. No. 3,747,530 recognizes the problems associated with energy losses and unreliability of transmission of laser energy through transparent windows associated with optical fibers.

None of the prior art laser actuated detonators have been successful in combining the three distinctive features of prior art electrically actuated thermo resistive detonators in low cost, reliability and safety.

SUMMARY OF THE INVENTION

Accordingly it is the aim of the present invention to provide an inexpensive, easily constructed detonator which has a high degree of reliability and which is safe to handle and store and is able to be produced at a marketable cost.

According to one aspect of the invention there is provided an optically actuable detonator comprising:

An elongated hollow body portion with a closed end containing a quantity of explosive material adjacent to the closed end; and a frequency converter element device located within the elongated hollow body portion, intermediate to a quantity of explosive material placed adjacent to the closed end, and an opening in the opposite end of the elongated hollow body portion adapted to receivably locate a terminal end of a fiberoptic light guide cable, the frequency converter element device having a quantity of initiating pyrotechnic material located on one surface adjacent the explosive material.

If required, a quantity of time delay pyrotechnic material may be located intermediate the initiating pyrotechnic material and the explosive material.

Preferably the frequency converter element device comprises a material capable of readily absorbing electromagnetic radiation and re-emitting a large proportion of this radiation in the form of short wave infrared radiation.

The frequency converter element device may be composed of any of a variety of materials or as combinations of these materials, such as metal, carbon, plastic or ceramic.

The frequency converter element device may be formed as a porous planar disc or as a closely woven fine gauge mesh screen, or arranged as a element of thin walled material to which a coating or layer of pyrotechnic material is attached or adhered to one surface of the frequency converter element device with a blackened absorber surface on the side adjacent to the output end of a fiberoptic light guide cable. Preferably the frequency converter element device comprises a material of low thermal conductivity.

Most preferably said frequency converter element device comprises a wall of reduced thickness.

Suitably the frequency converter element device comprises a Ni/Cr/Fe alloy such as stainless steel.

The frequency converter element device may be formed as a planar wall member within the elongated hollow body portion.

Most preferably the frequency converter element device has an adaptable device to locate the free end of a fiberoptic light cable entering the open end of the elongated hollow body portion.

Initiating pyrotechnic material is suitably located on the frequency converter element device in a position on the surface opposite the surface substantially aligned with the longitudonal axis of the adjacent positioned output end of a fiberoptic light guide cable which is entered and held co-axially aligned with the casing of the elongated hollow body portion.

The frequency converter element device may be held in place by securing to the wall of the elongated hollow body portion or may be located concentrically on the output end of fiberoptic light guide cable within the confines of the elongated hollow body portion.

Suitably a preferred arrangement of the invention utilizes a frequency converter element device composed of a porous planar disc or as a element formed as a closely woven light gauge mesh screen composed of carbon or carbon composition material or the like whereby a pyrotechnic material in the form of a thin coating or layer is attached or adhered to one surface of the frequency converter element device.

An additional quantity of pyrotechnic fusing material may be placed in close proximity to the pyrotechnic coating of the frequency. element device to provide a more positive flashing means to ignite the main explosive material. This additional material may provide a suitable time delay device in the firing detonator. A frequency converter element device would be similiarly located and fixed as the before mentioned metal version of the device.

DESCRIPTION OF THE DRAWING

In order that the invention may be more clearly understood, reference is made to preferred embodiments illustrated in the accompanying drawings in which.

DETAILED DESCRIPTION OF THE PREFERRED EMBODIMENTS

Figure 1:
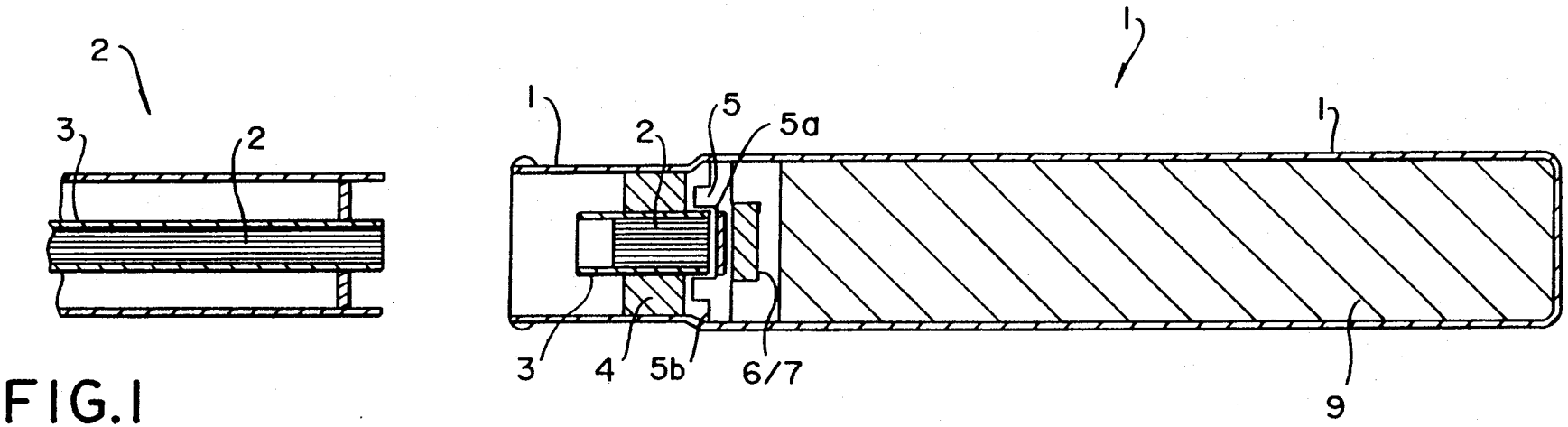
FIG. 1 illustrates a cross sectional view of one form of the invention.

In FIG. 1 the detonator comprises a thin walled metal body 1 of any suitable metal such as aluminum, brass, copper or the like.

A fiberoptic cable 2 with a protective covering sheath 3 is located in one end of body 1 by means of a plug 4 which is firmly located by crimping the wall of body 1 adjacent each end of plug 4.

A thin walled frequency element 5 is frictionally engaged over the free end of fiberoptic cable 2, the inner end surface 6 of the cap being of a non-reflective nature.

The end wall 6 may be a carbon absorber or may be composed of metal and have a non reflective coating such as metal oxide formed by any suitable process.

The frequency converter element means may be formed of sheet metal foil or thin sheet metal having a thickness in the range of 0.01 mm to 0.10 mm, preferably in the range of 0.03 mm to 0.06 mm.

Coated on the outer surface of cap 5 is an initiating pyrotechnic material 7 of conventional composition and suitably of the type employed in conventional electrically actuated thermo resistive detonators. Such compositions are of the deflagrating type wherein no substantial shattering of the crystal structure occurs during combustion. A similar material is applied to an optional time delay component.

Deflagrating compositions typically are chosen from PETN, RDX tetryl, black powder, metal oxides, metallized polymers, various powdered fuels, high temperature and carbon oxidant mixtures. For the fusing means composition may include a binder such as a lacquer or the like, similar to the common electric detonator.

Spaced from the initiating pyrotechnic material 7 is an optional chemical time delay compound intimately placed against a high explosive compound 9 of a type suitable for detonation of a mass of explosive material such as dynamite, gelignite, ANFAR explosive, annomium nitrate/fuel mixtures or the like.

The exposed free end of fibre-optic cable 2 (not shown) may be fitted with a conventional fiberoptic coupling device (also not shown).

In use, the detonator of FIG. 1 may be optically coupled to a suitable electromagnetic radiation emission device capable of emitting an energy pulse sufficient to heat cap 5 to emit a quantity of infra-red radiation which is enough to ignite pyrotechnic material 7.

For the detonator illustrated, a pulse energy of from 0.2 to 0.4 joules is sufficient to ignite pyrotechnic material 7 without the risk of penetrating cap 5.

The radiant energy pulse is emitted from the end of fiberoptic cable 2 and it impinges on the axially aligned face of cap 5 opposite pyrotechnic material 7. The relatively short wavelength energy is absorbed in cap 5 and is re-emitted in the form of a longer wavelength infrared radiation. As the material used is a relatively poor conductor of heat, little heat loss due to conduction to other parts of cap 5 is encountered such that substantially only the irradiated region of cap 5 becomes heated.

By confirming the heated region of cap 5 to a face opposite that upon which the pyrotechnic composition is adhered, the relatively thin wall of cap 5 allows heat to be concentrated and retained in the region of the pyrotechnic material 7 for a sufficient time and at a sufficient intensity to ensure reliable ignition of the pyrotechnic material 7.

The operation of the optically actuated detonator described above may be considered as analogous to the reliable electrically actuated detonators which employ a resistive metal filament to ignite the pyrotechnic material.

Prior art "optic" detonators in marked contrast rely upon ignition of pyrotechnic materials by direct impingement of optical radiation on a surface of the pyrotechnic material. The pyrotechnic materials are in themselves inefficient in converting optical energy to infra-red radiation as insufficient heat is generated in the short time of radiation giving rise to unreliable performance. Attempts to improve reliability by utilizing higher energy pulses often cause penetration of the pyrotechnic material without ignition thereof.

Figure 2:
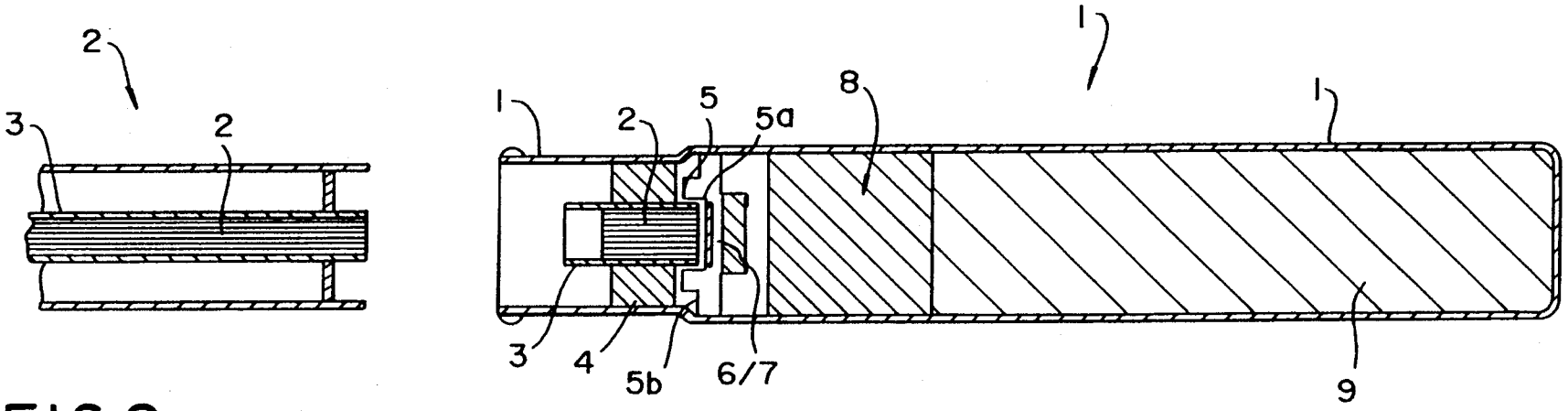
FIG. 2 illustrates an alternative form of the invention.

FIG. 2 shows an alternative embodiment of the detonator of FIG. 1.

In FIG. 2 the detonator comprises a time delay pyrotechnic material 8 of conventional type. The pyrotechnic material 8, when ignited by the initiating pyrotechnic material 7, burns at a predetermined rate before detonating explosive material 9.

Figure 3:
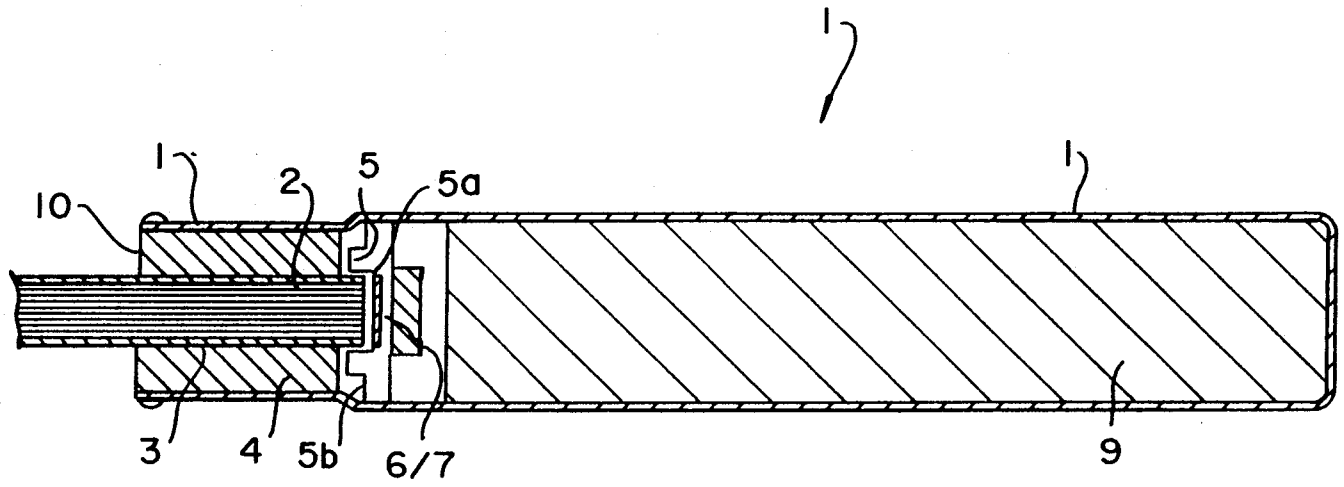
FIG. 3 illustrates yet another form of the invention.

FIG. 3 shows yet another form of the invention.

In this embodiment, the frequency converter 5 comprises a thin walled frequency converter element having a central recess 5*a* to receive the end of fiberoptic cable and a peripheral flange 5*b* which is frictionally located in body 1 by crimping or is otherwise located by any other suitable means.

The detonator may be manufactured with a suitable length of fiberoptic cable attached thereto, the free end of the fiberoptic cable terminating in an optical coupling device.

Alternatively the detonator may be manufactured without a fiberoptic cable attached. The plug 4 may be made of a resilient polymeric material or other deformable material with a central cable receiving aperture. Over the end of plug 4 is a thin piercable closure 10 such as a plastic film or aluminum foil to protect the detonator against ingress of contaminants such as water, dirt etc.

In use the free end of a fiberoptic cable is pushed through the closure 10 to pierce an aperture therein to pass through the opening as the aperture in plug 4 until the free end abuts against the inner wall 6 of cap 5. The resilient plug 4 firmly retains the fiberoptic cable.

In the variation described above, the use of expensive fiberoptic couplers may be avoided.

It will be clear to a skilled addressee that many modifications and variations may be made to the invention without departing from the spirit and scope thereof.

I claim:

1. An optical detonator comprising:

an elongated hollow body portion having a closed end containing a quantity of explosive material adjacent to said closed end, said elongated hollow body having an opening in an opposite end;

a fiberoptic cable having a terminal end receivably located in said opening of said elongated hollow body portion;

a frequency converter element means located within said elongated hollow body intermediate to said explosive material; and a quantity of initiating pyrotechnic material located on one surface of said frequency converter element means which is adjacent said explosive material, wherein said frequency converter element means is composed of a material capable of readily absorbing electromagnetic radiation.

2. An optical detonator according to claim 1 wherein said material capable of readily absorbing electromagnetic radiation is selected from a group consisting of metal, carbon, carbon compositions, plastic and ceramic formed as a planar disc as a closely woven fine gauge mesh screen.

3. An optical detonator comprising:

an elongated hollow body portion having a closed end containing a quantity of explosive material adjacent to said closed end, said elongated hollow body having an opening in an opposite end;

a fiberoptic cable having a terminal end receivably located in said opening of said elongated hollow body portion;

a frequency converter element means located within said elongated hollow body intermediate to said explosive material; and a quantity of initiating pyrotechnic material located on one surface of said frequency converter element means which is adjacent said explosive material, wherein said frequency converter element means is composed of a metal formed as a planar wall member within said elongated hollow body portion having a non-reflective coating formed on one surface adjacent to said fiberoptic cable terminal end.

4. An optical detonator according to claim 3 wherein said metal formed as said planar wall member is stainless steel.

5. An optical detonator according to claim 3 wherein said non-reflective coating is metal oxide.

* * * * *